US007862369B2

(12) United States Patent
Gimenes et al.

(10) Patent No.: US 7,862,369 B2
(45) Date of Patent: Jan. 4, 2011

(54) BACKSHELL COUPLING FOR AN ELECTRICAL COMPONENT

(75) Inventors: Jean-Paul Gimenes, Scionzier (FR); Laurent Lagrange, Bonneville (FR)

(73) Assignee: Amphenol Socapex S.A., Paris (FR)

( * ) Notice: Subject to any disclaimer, the term of this patent is extended or adjusted under 35 U.S.C. 154(b) by 0 days.

(21) Appl. No.: 12/622,505

(22) Filed: Nov. 20, 2009

(65) Prior Publication Data

US 2010/0124837 A1 May 20, 2010

(30) Foreign Application Priority Data

Nov. 20, 2008 (FR) ..... 08 57899

(51) Int. Cl.
*H01R 13/56* (2006.01)

(52) U.S. Cl. ..... 439/446; 439/470

(58) Field of Classification Search ..... 439/446, 439/470

See application file for complete search history.

(56) References Cited

U.S. PATENT DOCUMENTS 6,419,519 B1 7/2002 Young
6,676,420 B1 1/2004 Liu et al.
7,544,085 B2 * 6/2009 Baldwin et al. ..... 439/471
2008/0009173 A1 1/2008 Carnahan et al.
2009/0130894 A1 * 5/2009 Baldwin et al. ..... 439/470

OTHER PUBLICATIONS

French Search Report, Mar. 18, 2009.

* cited by examiner

*Primary Examiner*—Gary F. Paumen
(74) *Attorney, Agent, or Firm*—Blank Rome LLP

(57) ABSTRACT

The invention relates to a backshell coupling for connecting an electrical cable to an electrical component, the coupling comprising a first part having a cylindrical sleeve suitable for passing the cable, the sleeve having an end provided with a first pair of arms; and a second part having guide means for said cable and a second pair of arms, the free ends of the first arms facing the ends of the second arms, with one of the pairs of ends being disposed between the other pair of ends;

means defining a pivot axis between the pairs of arms, the facing faces of said ends being provided with portions in relief for defining a plurality of relative angular positions between the two parts, the arms having their ends disposed between the ends of the other arms being elastically deformable; and means for temporarily deforming the arms.

6 Claims, 3 Drawing Sheets

BACKSHELL COUPLING FOR AN ELECTRICAL COMPONENT

FIELD OF THE INVENTION

The present invention relates to a backshell coupling for an electrical component.

A backshell coupling is a mechanical device that is designed to be fastened to the back of an electrical component, and particularly but not exclusively of an electrical connector. The function of the backshell coupling is either to provide a mechanical connection between the body of the electrical component and the cable connected thereto or more usually connected to the electrical connector, or else additionally to provide the electrical cable, particularly when it presents a degree of rigidity, with an orientation that is well determined and that can be varied relative to the axis of the electrical component, and in particular the axis of the electrical connector.

The invention relates to the second type of backshell coupling that further enables the electrical cable associated with the electrical component to be given a predetermined adjustable orientation relative to the axis of the electrical component.

BACKGROUND OF THE INVENTION

U.S. Pat. No. 6,419,519 describes such a backshell coupling that enables an adjustable predetermined orientation to be given to an electrical component connected to an electrical connector.

The backshell coupling described in that document is essentially constituted by two parts. The first part is designed to be mechanically coupled to the electrical component and is extended by two parallel arms that have pivotally mounted thereon two likewise parallel arms with second ends that are secured to the cable that is connected to the electrical component. This defines a possibility for pivoting between the axis of the electrical component and the cable. In order to define the direction of the cable relative to the axis of the electrical component, various mechanical means are proposed. Under all circumstances, those mechanical means require a user who is adjusting the direction of the cable relative to the axis of the electrical component to proceed at least with operations of loosening and tightening screw fastener means.

It will be understood that given the nature of those operations, it is not possible for a single operator both to hold the angle that is desired between the electrical component and the cable and also to perform said operations, in particular tightening, so as to define the direction of the cable at the outlet from the electrical component in a manner that is stable.

OBJECT AND SUMMARY OF THE INVENTION

An object of the present invention is to provide a backshell coupling for an electrical component in which the direction of the cable associated with the electrical component is adjusted relative to the axis of the component in a manner that is simpler, thereby enabling a single operator to perform the entire operation.

The invention concerns a backshell coupling for connecting an electrical cable to an electrical component, the coupling comprising:

a first hinged part comprising a cylindrical sleeve suitable for passing the cable, the sleeve having a first end for coupling to said electrical component and a second end, the first part having a first pair of arms that are substantially parallel to each other and that extend from said second end of the sleeve;

a second part having guide means for guiding said cable and a second pair of arms secured to said guide means, said arms being substantially parallel to each other, the free ends of the arms of the first pair facing the ends of the arms of the second pair, one of said pairs of ends being disposed between the other pair of ends; and means defining a pivot axis for one pair of arms to pivot relative to the other, and co-operating with the ends of the pairs of arms, the facing faces of said ends being provided with portions in relief for defining a plurality of relative angular positions for the two parts, the arms having their ends disposed between the ends of the other arms being elastically deformable; and means for temporarily causing the deformable arms to deform so as to enable the parts to pass from one angular position to another angular position.

It will be understood that using this backshell coupling and thus modifying the angle between the two parts is very simple since it suffices to act on the means that enable one of the pairs of arms to be deformed temporarily, thereby decoupling the portions in relief that serve to define the predetermined angular positions.

Preferably, the means defining the pivot axis and the means for causing temporary deformation of a pair of arms are the same means.

In a preferred embodiment, the means defining a pivot axis and the means for causing the arms to deform comprise two pushers, each pusher comprising a cylindrical body connected to a cylindrical head, each head being disposed between the facing faces of the ends of one arm in each pair, said body passing freely through the end of the arm of the first pair of arms via a circular orifice centered on said pivot axis and having a portion outside said end enabling thrust to be exerted on said end, said head penetrating into a blind hole formed in the end of the arm of the second pair of arms, said blind hole being centered on said pivot axis.

It will be understood that in this embodiment, it suffices to press simultaneously on the outside portions of the two pushers to deform the arms of the inner pair of arms elastically, thereby decoupling the portions in relief formed at the facing faces of the ends of the pairs of arms.

BRIEF DESCRIPTION OF THE DRAWINGS

Other characteristics and advantages of the invention appear better on reading the following description of embodiments of the invention given as non-limiting examples. The description refers to the accompanying figures, in which.

MOST DETAILED DESCRIPTION

Figure 1:
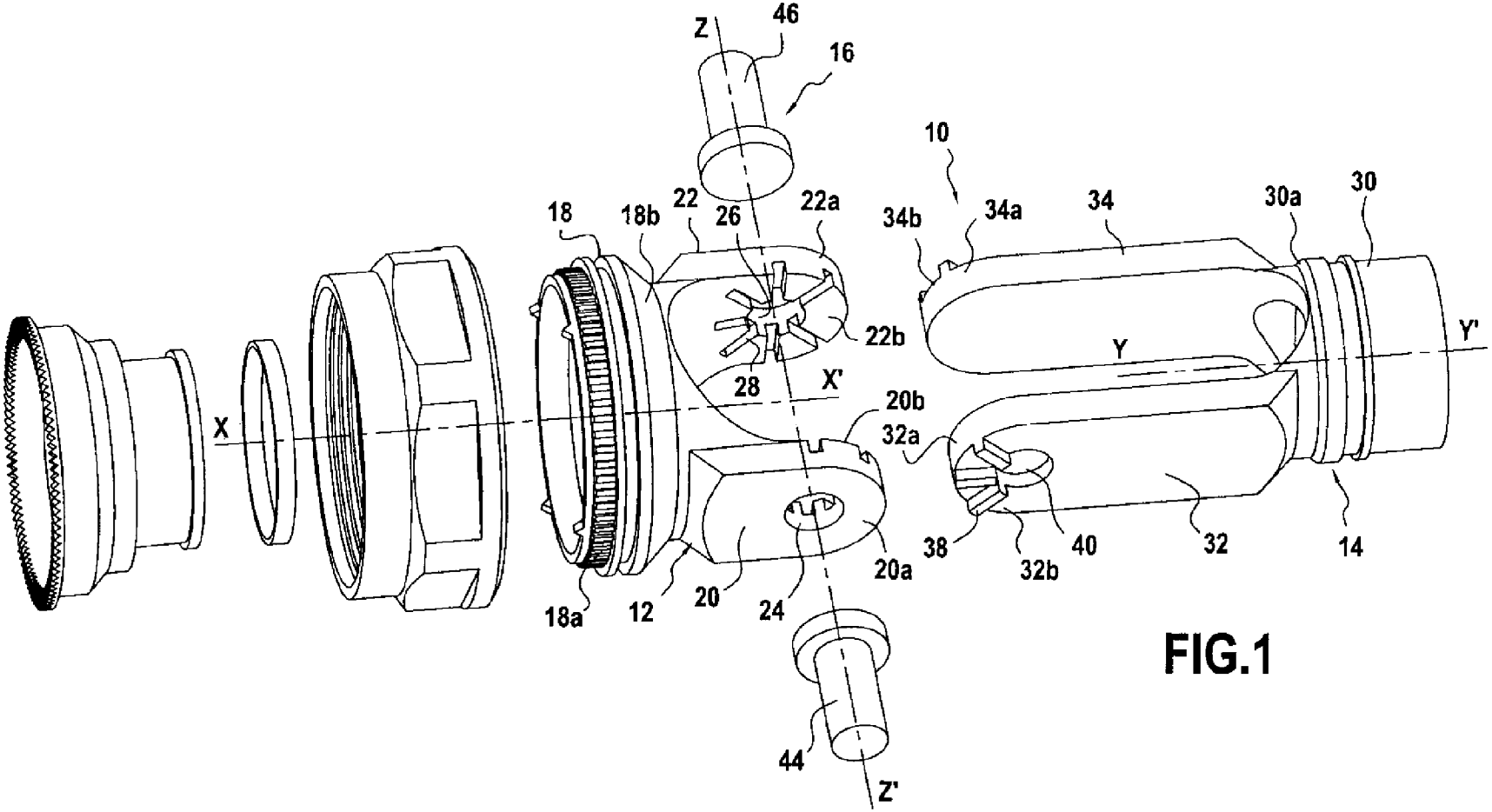
FIG. 1 is an exploded view in perspective of the backshell coupling.
Figure 2:
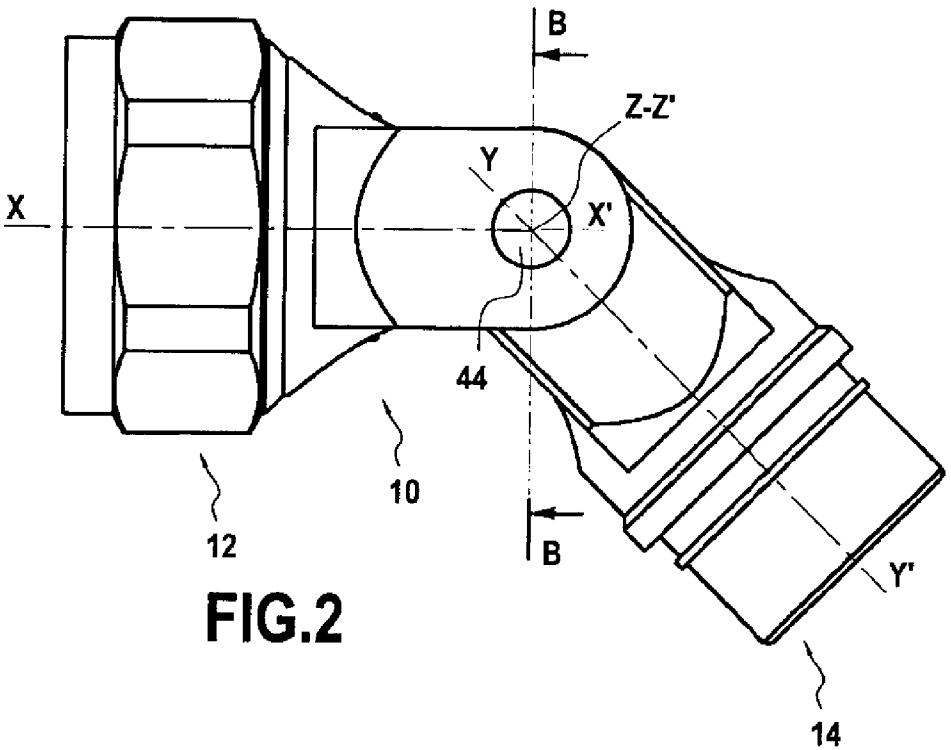
FIG. 2 is a side view of the backshell coupling mounted in a position enabling an angle of 90° to be used between the axis of the electrical component and the direction of the electrical cable.
Figure 3:
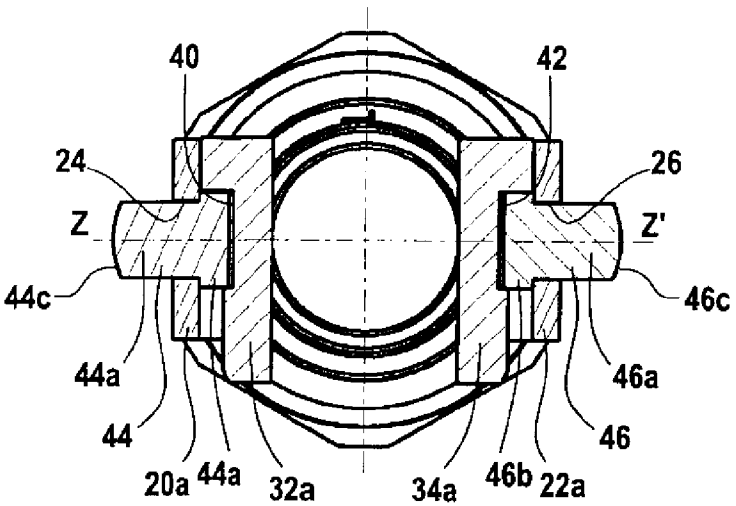
FIG. 3 is a cross-section view on plane B-B of FIG. 2.

With reference initially to FIGS. 1 to 3, there follows a description of a preferred embodiment of the backshell coupling of the invention.

The backshell coupling given overall reference 10 is constituted essentially by a first part 12, a second part 14, and means 16 forming a hinge axis between the two parts and enabling the two parts 12 and 14 to be oriented relative to each other.

The first part 12 comprises a sleeve 18 with an end 18*a* that serves for coupling with an electrical component (not shown in the figure) and with a second end 18*b* that is provided with two parallel arms 20 and 22 that extend in the direction XX' of the axis of the sleeve-shaped portion 18. As can be understood, this axis XX' is also the axis of the electrical component with which the backshell coupling 10 is associated. The arms 20 and 22 have free ends 20*a* and 22*a* each provided with respective cylindrical orifices 24 and 26 lying on the pivot axis ZZ' between the parts 12 and 14. On their inside faces 22*b* and 20*b*, the ends 20*a* and 22*a* of the arms 20 and 22 are provided with portions 28 in relief that are radiating or radial relative to the axis ZZ'. As explained below, the portions in relief 28 constitute part of the means enabling the relative angle between the parts 12 and 14 to be determined.

Consideration is now given to the second part 14, which is of similar structure and is constituted by a cylindrical sleeve 30 having one end 30*a* fitted with two arms 32 and 34 that are mutually parallel and also parallel to the axis YY' of the sleeve 30. The arms 32 and 34 present respective ends 32*a* and 34*a*. The outside faces 32*b* and 34*b* of the ends 32*a* and 34*a* are provided with blind holes 40 on a common axis that coincides with the axis ZZ' when the parts 12 and 14 are assembled together. It should be specified that the pivot axis between the two parts 12 and 14 and referenced ZZ' is naturally orthogonal to the longitudinal axes XX' and YY' respectively of the parts 12 and 14. The outside faces 32*b* and 34*b* of the ends of the arms 32 and 34 are also provided with portions in relief 38 that radiate relative to the axis ZZ' of the blind holes 40. These portions in relief 38 are designed to co-operate with the portions in relief 28 of the arms 22 and 24 in order to define a plurality of angular positions for the part 12 relative to the part 14 about the pivot axis ZZ'.

With reference more particularly to FIG. 3, there follows a description of how the pivot axis ZZ' between the parts 12 and 14 is implemented and how the means for enabling the parts 12 and 14 to pass from one angular position to another are implemented.

These means 16 are constituted by two pushers 44 and 46 of generally cylindrical shape. Each pusher 44, 46 comprises a body 44*a*, 46*a* and a head 44*b*, 46*b*. The body of each pusher has an outside diameter that is slightly smaller than the diameter of the orifices 24 and 26 formed in the ends of the arms 20 and 22. When the parts are assembled together, the ends 32*a* and 34*a* of the arms 32 and 34 are inserted between the ends of the arms 20 and 22, as can be seen more clearly in FIG. 3. The heads 46*b* and 44*b* of the pushers 44 and 46 are of diameter greater than the diameter of their respective bodies 44*a* and 46*a* and slightly smaller than the diameter of the blind holes 42 that are formed in the ends of the arms 32 and 34. Because the pusher head pushers 44*b* and 46*b* are of larger diameter, the pushers are held captive between the ends of the arms 20 & 32 and 22 & 34, and the pushers themselves can move in translation in the orifices 24 and 26. The material and the dimensions of the arms 32 and 34 are such as to enable them to be deformed temporarily in bending so that their ends 32*a* and 34*a* move towards each other. It will be understood that once the pushers 44 and 46 are engaged both in the orifices 24 and 26 of the arms 40 and 22 and in the blind holes 42 of the arms 32 and 34, they define a pivot axis ZZ'. Furthermore, by pressing against the outer ends 46*c* and 44*c* of the pushers, the user can cause the arms 32 and 34 to bend so that their ends move towards each other, thereby enabling the portions in relief 38 to move out from the portions in relief 28 formed in the ends of the arms 20 and 22. While the user continuous to exert pressure on the ends 44*c* and 46*c* of the pushers, the user can cause the part 14 to pivot freely relative to the part 12 about the axis ZZ' until these parts occupy a relative position associated with the desired angle. When this position is reached, the pressure exerted on the pushers 44 and 46 is released, and the portions in relief 28 and 42 re-engage in the desired angular position.

As can be understood, an electrical cable (not shown) is placed inside the sleeves 18 and 30 of the parts 12 and 14 of the backshell coupling 10. The end of the cable mounted in the part 12 is for coupling to the electrical component mounted at the end 18*a* of the sleeve 18. In contrast, the sleeve 30 of the part 14 serves to guide the direction of the cable, which direction is imposed by the relative angular position of the parts 12 and 14.

It can be understood that the general structure of the backshell coupling of the invention is very simple, since it requires only two pairs of parallel arms with two pushers inserted between the ends thereof, the pushers being suitable for being actuated from the outside so as to allow the part 14 to pivot relative to the part 12. Use is thus extremely simple, since it suffices for the user to exert pressure on the ends 44*c* and 46*c* of the pushers in order to release the parts 12 and 14 angularly, and thus give the desired orientation to the cable at the outlet the electrical component to which it is connected.

Figure 4A:
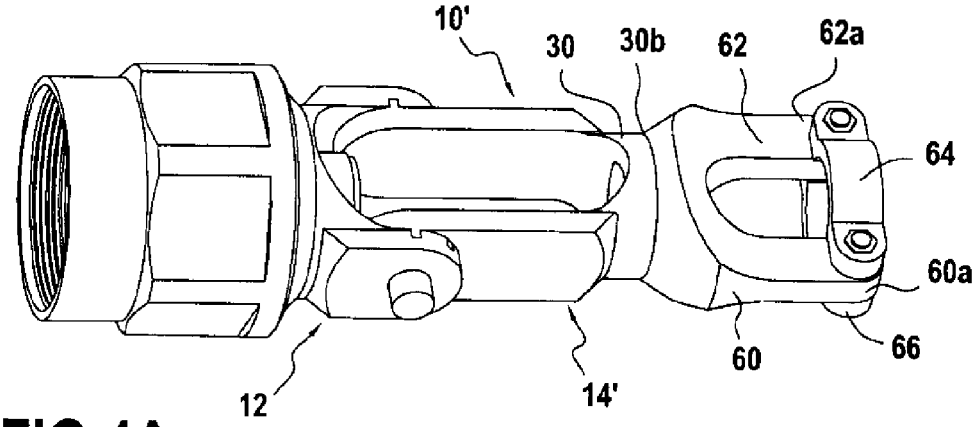
FIGS. 4A to 4C show different possible orientations of the cable relative to the electrical component.
Figure 4B:
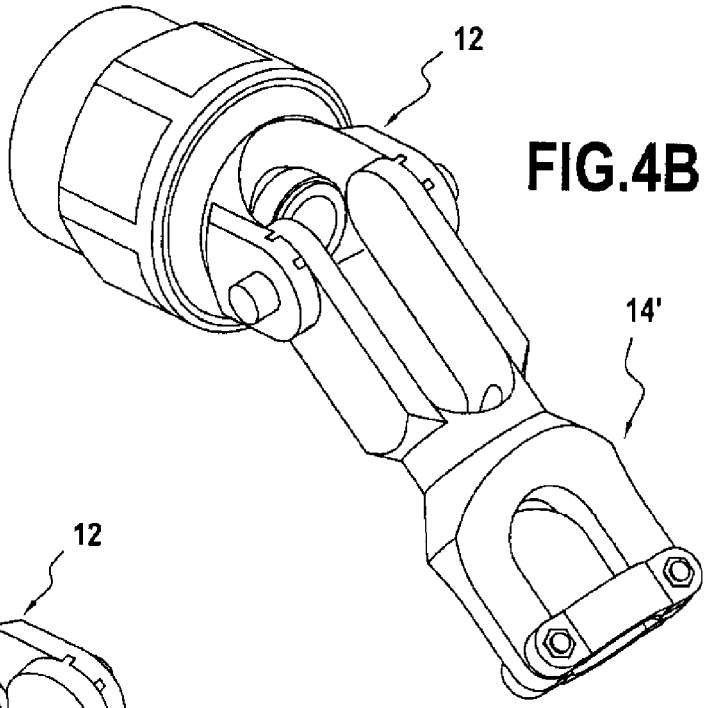
Figure 4C:
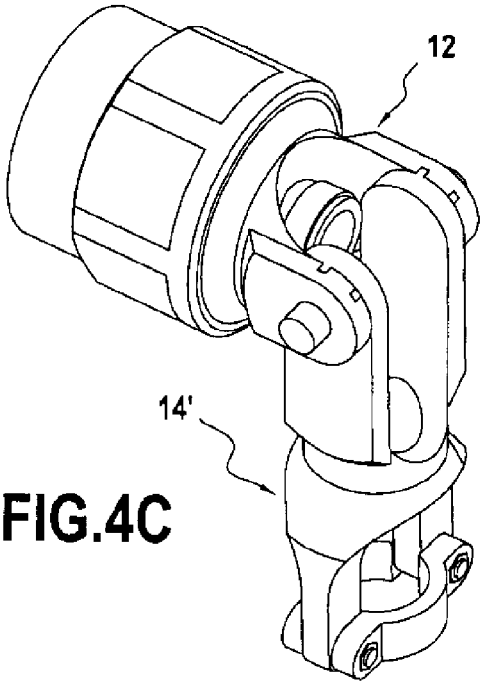

FIGS. 4A to 4C show a variant embodiment of the backshell coupling 10' in three possible angular positions in which the two parts 12 and 14' are respectively in alignment (FIG. 4A), form between them an angle of 45 degrees (FIG. 4B), and form them between a angle of 90 degrees (FIG. 4C). In this variant embodiment, the only modification relates to the second part 14, which is given the reference 14'. In this embodiment, the sleeve 30 has a second end 30*b* that is extended by two arms 60 and 62 that are parallel to each other and to the axis YY' of the part 14'. The ends 60*a* and 62*a* of these arms are designed to receive the ends of two clamping collars 64 and 66 that are designed to clamp mechanically against the cable between the arms 60 and 62. This provides a better mechanical connection between the cable and the part 14', and thus a better mechanical connection between the body of the electrical component connected to the part 12 and the electrical cable itself.

In the above description, the portions in relief made at the ends of the two pairs of arms are in a radiating configuration and they constitute the equivalent of a jaw clutch having different angular orientations. Naturally, the means for defining the different angular positions that can be occupied by the parts 12 and 14 or 12 or 14' could be of some other kind on condition that, when the arms 32 and 34 are at rest, the portions in relief co-operate with one another, and when pressure is exerted on the ends of the arms via the pushers 44 and 46, the deformation thereof enables the portions in relief provided at the end of the pairs of arms to be disengaged.

What is claimed is:

1. A backshell coupling for connecting an electrical cable to an electrical component, the coupling comprising:

a first hinged part comprising a cylindrical sleeve suitable for passing the cable, the sleeve having a first end for coupling to said electrical component and a second end, the first part having a first pair of arms that are substantially parallel to each other and that extend from said second end of the sleeve;

a second part having guide means for guiding said cable and a second pair of arms secured to said guide means, said arms being substantially parallel to each other, the free ends of the arms of the first pair facing the ends of the arms of the second pair, one of said pairs of ends being disposed between the other pair of ends; and means defining a pivot axis for one pair of arms to pivot relative to the other, and co-operating with the ends of the pairs of arms, the facing faces of said ends being provided with portions in relief for defining a plurality of relative angular positions for the two parts, the arms having their ends disposed between the ends of the other arms being elastically deformable; and means for temporarily causing the deformable arms to deform so as to enable the parts to pass from one angular position to another angular position.

2. A backshell coupling according to claim 1, wherein the means defining the pivot axis and the means for causing temporary deformation of a pair of arms are the same means.

3. A backshell coupling according to claim 1, wherein the ends of the second pair of arms are disposed between the ends of said first pair of arms.

4. A backshell coupling according to claim 3, wherein the means defining a pivot axis and the means for causing the arms to deform comprise two pushers, each pusher comprising a cylindrical body connected to a cylindrical head, each head being disposed between the facing faces of the ends of one arm in each pair, said body passing freely through the end of the arm of the first pair of arms via a circular orifice centered on said pivot axis and having a portion outside said end enabling thrust to be exerted on said end, said head penetrating into a blind hole formed in the end of the arm of the second pair of arms, said blind hole being centered on said pivot axis.

5. A backshell coupling according to claim 4, wherein said head of each pusher has a diameter greater than the diameter of the body, said circular orifice having a diameter that is slightly greater than the diameter of said body and the blind hole having a diameter that is slightly greater than that of said head, whereby said head is held between the ends of said arms.

6. A backshell coupling according to claim 1, wherein said portions in relief extend radially relative to said pivot axis.

* * * * *